United States Patent [19]

Baker

[11] 4,082,214

[45] Apr. 4, 1978

[54] CONTAINER ASSEMBLY AND METHOD OF USING

[76] Inventor: Howard W. Baker, Rte. No. 1, Box 11, Terra Bella, Calif. 93270

[21] Appl. No.: 794,629

[22] Filed: May 6, 1977

[51] Int. Cl.[2] ..... B65D 13/04

[52] U.S. Cl. ..... 229/23 R; 229/32; 229/15

[58] Field of Search ..... 229/18, 23 R, 33, 43

[56] References Cited

U.S. PATENT DOCUMENTS

| | | | |
|---|---|---|---|
| 1,563,907 | 12/1925 | Koff | 229/32 X |
| 1,667,354 | 4/1928 | Lupiem | 229/32 |
| 3,185,379 | 5/1965 | Kohlhaas | 229/15 X |
| 3,261,532 | 7/1966 | Davis | 229/6 R |
| 3,403,835 | 10/1968 | Schwamer | 229/15 |
| 3,704,824 | 12/1972 | Croley | 229/32 |
| 3,967,772 | 7/1976 | Baker | 229/18 |

*Primary Examiner*—Davis T. Moorhead
*Attorney, Agent, or Firm*—Burns, Doane, Swecker & Mathis

[57] ABSTRACT

A container assembly comprises a master container and a plurality of sub-containers to be carried therein. The master container and the sub-containers are of the knock-down reusable type. Each container includes foldable sides which are maintained in an erected posture by resilient band. Each container provides a pair of corner folds at each corner which are effective to withstand vertical and torsional loads. The master container and sub-containers thus collectively provide four corner folds at each corner, and four corner folds at points along the side walls where two corners of two sub-containers meet. If four or more sub-containers are employed, eight corner folds are provided internally of the master container where four corners of the sub-containers meet. The container assembly is thus able to withstand substantial vertical and torsional loads during shipping. By removing the band from the master container, the sides thereof can be collapsed, exposing the sub-containers. The latter can be removed and carried to the shelves so as to avoid cluttering aisles with containers the size of the master containers. By then removing the band from the sub-container, its contents can be easily removed or, in regard to fruits, spilled into a bin or shelf.

8 Claims, 11 Drawing Figures

Fig. 1
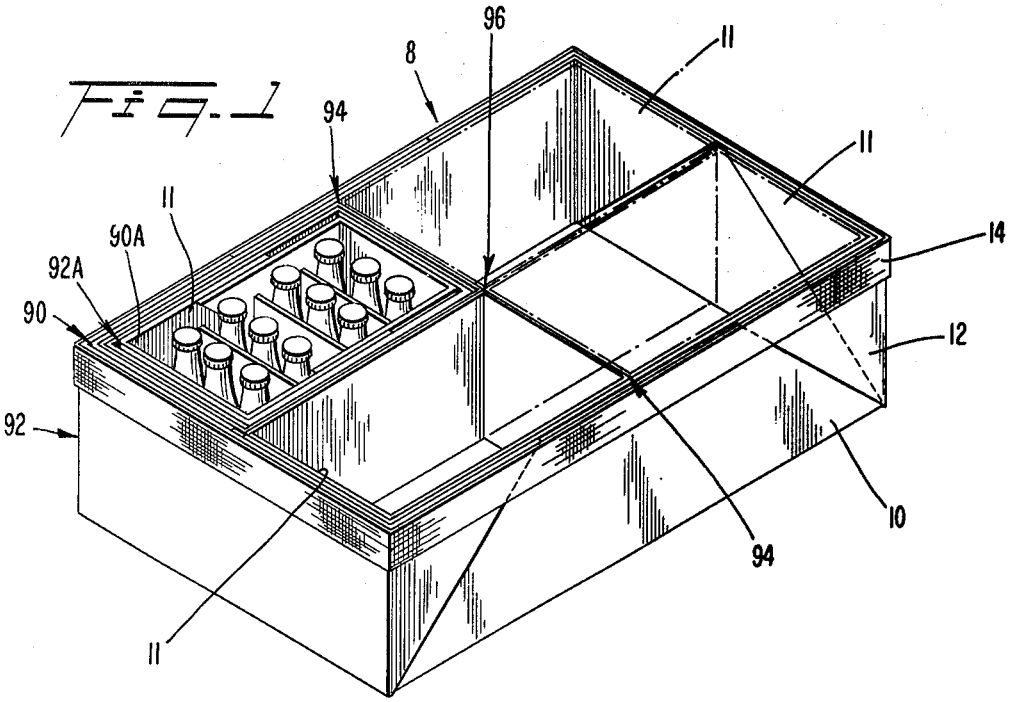
Fig. 2
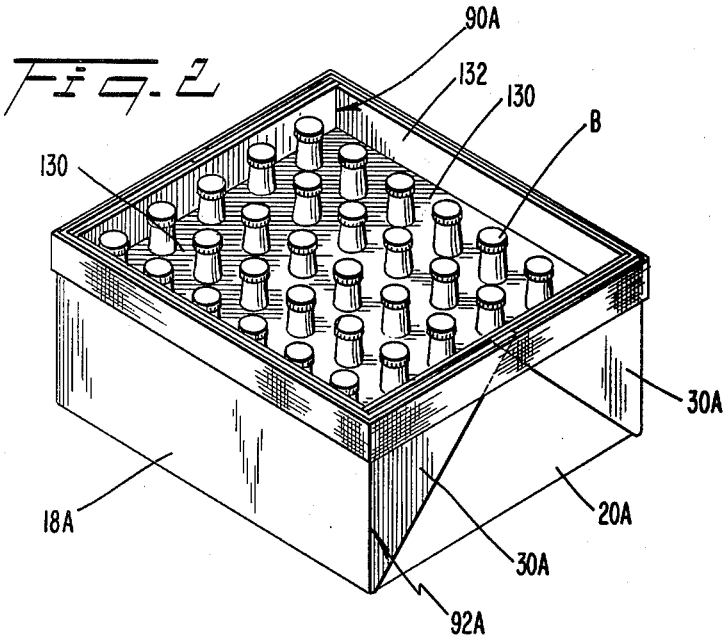
Fig. 9
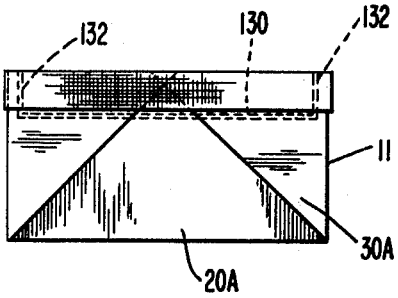
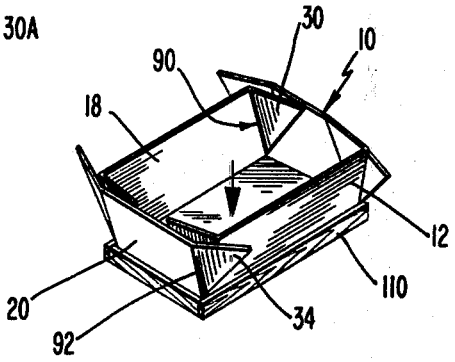
Fig. 10
Fig. 11
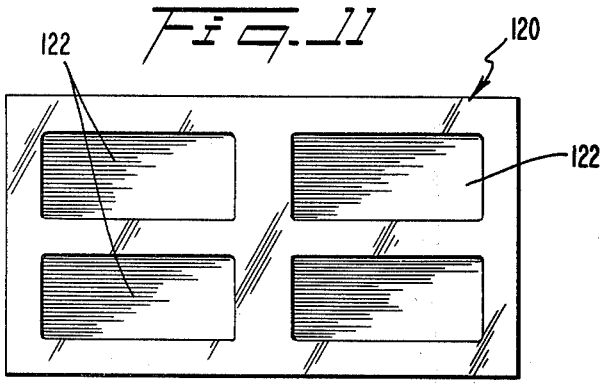

CONTAINER ASSEMBLY AND METHOD OF USING

BACKGROUND AND OBJECTS

This invention relates to knock-down container assemblies formed of non-metallic material and adapted for reuse.

The shipment of goods is often performed using rigid rectangular cartons formed of pressed fibrous material or corrugated paperboard and the like. Upon being erected, the carton is glued, stapled or otherwise secured together in a manner imparting structural rigidity. Rather significant amounts of material must be employed in the construction of such cartons in order to assure that the cartons exhibit sufficient strength to withstand loads encountered upon vertical stacking during shipment and storage. Due to their rigid fastening, the cartons are not easily broken down for reuse.

During shipment and storage such cartons are typically stacked in vertical fashion. Due to the limited capacity of such cartons for withstanding vertical loading, the size of the cartons must be limited so as to maintain the stacking loads within limits that can be supported by the lowermost cartons. As a result, the ratio between the amount of container material being utilized relative to the overall container volume becomes undesirably high.

Once the cartons reach an unloading station, such as a retail store, they must be unloaded. Often this entails carrying the cartons into the store aisles so that the goods may be inserted onto the shelves. As a result, customer access to aisles and shelves can be blocked.

It may be necessary to expend time and labor in ripping the carton apart in order to remove the goods or to thereafter dispose of the cartons. Destruction and disposal of the cartons is particularly wasteful since otentimes the cartons are still structurally sound.

This inventor has previously proposed containers for solving some of the above-discussed problems, see for example U.S. Pat. No. 3,967,772 issued July 6, 1976. Notwithstanding the advances in the art contributed by this proposal, significant room for improvement still remains.

It is, therefore, an object of the present invention to minimize or obviate problems of the types earlier described.

It is another object of the present invention to provide novel methods and apparatus for handling goods.

It is another object of the present invention to provide a novel container assembly which is highly rigid to withstand vertical and torsional loading and which can be easily broken down for reuse.

It is another object of the invention to enable goods to be transported in bulk and then broken down into smaller easily-handled units for ultimate handling.

It is another object of the invention to enable goods to be transferred to store shelves with reduced blockage of aisles.

BRIEF SUMMARY

In accordance with the present invention a container assembly comprises a master container and a plurality of sub-containers to be carried therein. The master container and the sub-containers are of the knock-down reusable type. Each container includes foldable sides which are maintained in an erected posture by a flexible resilient band. Each container provides a pair of corner folds at each corner which are effective to withstand vertical and torsional loads. The master container and sub-containers thus collectively provide four corner folds at each corner, and four corner folds at points along the side walls where two corners of two sub-containers meet. If four or more sub-containers are employed, eight corner folds are provided internally of the master container where four corners of the sub-containers meet. The container assembly is thus able to withstand substantial vertical and torsional loads during shipping.

By removing the band from the master container, the sides thereof can be collapsed, exposing the sub-containers. The latter can be removed and carried to the shelves so as to avoid cluttering aisles with containers the size of the master containers. By then removing the band from the sub-container, its contents can be easily removed or, in regard to fruits, spilled into a bin or shelf.

THE DRAWINGS

The advantages of the present invention will become apparent from the subsequent detailed description thereof in connection with the accompanying drawings in which:

FIG. 1 is an isometric view of a container assembly according to the present invention in which a master container carries four sub-containers, one of the sub-containers carrying bottled goods;

FIG. 2 is an isometric view of a sub-container according to the present invention, carrying bottled goods retained by a spacer;

FIG. 9 is a side view of a sub-container containing a bottle separator, depicting the orientation of the spacer;

FIG. 10 is an isometric view depicting the erection of a container by means of an erecting form; and FIG. 11 is a plan view of a tray for carrying a plurality of sub-containers.

DETAILED DESCRIPTION OF THE PREFERRED EMBODIMENTS

Figure 3:
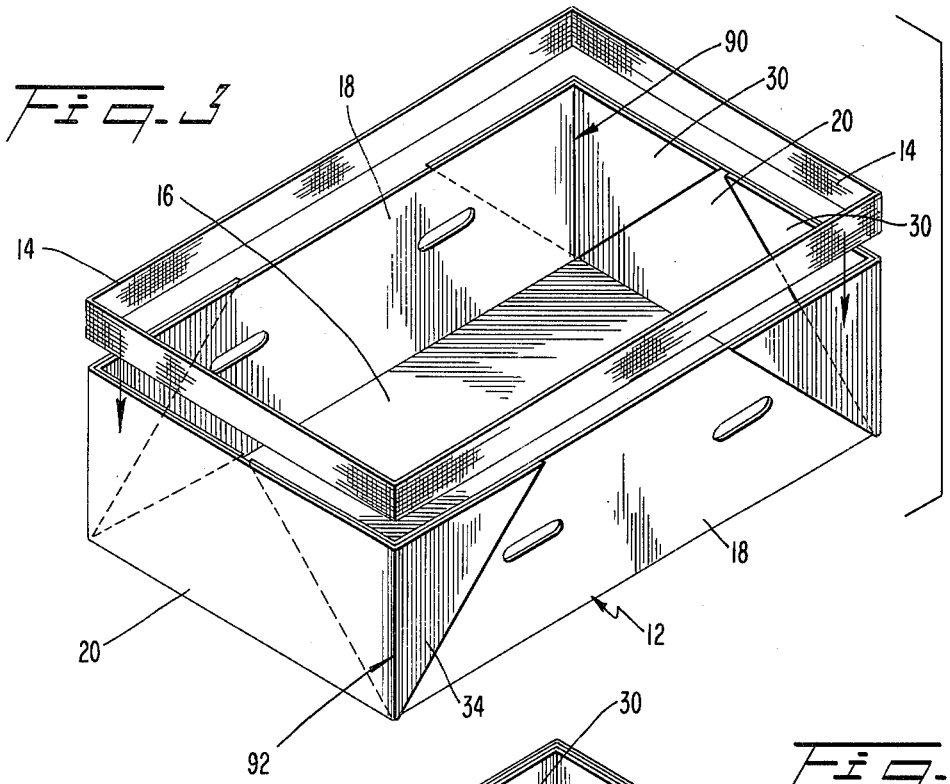
FIG. 3 is an isometric exploded view of a master container.
Figure 4:
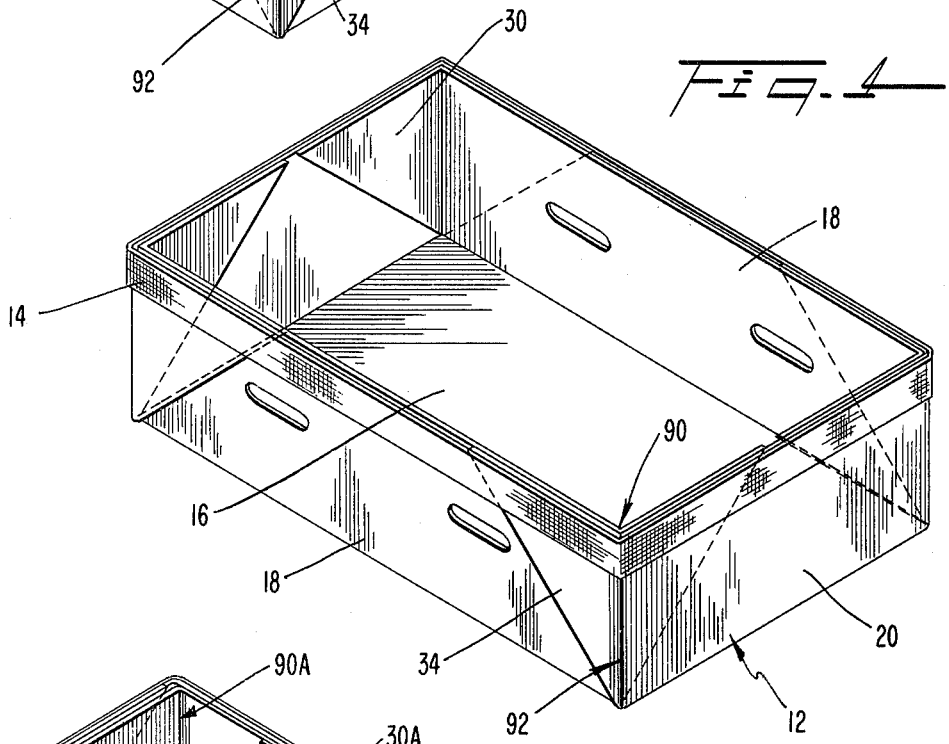
FIG. 4 is an isometric view of an empty master container.

Referring to FIG. 1 of the drawings, there is disclosed a container assembly 8 comprising a master container 10 and four sub-containers 11. The master container 10 comprises a base or compartment-defining portion 12 and a retaining collar or band 14 (FIG. 3).

Figure 6:
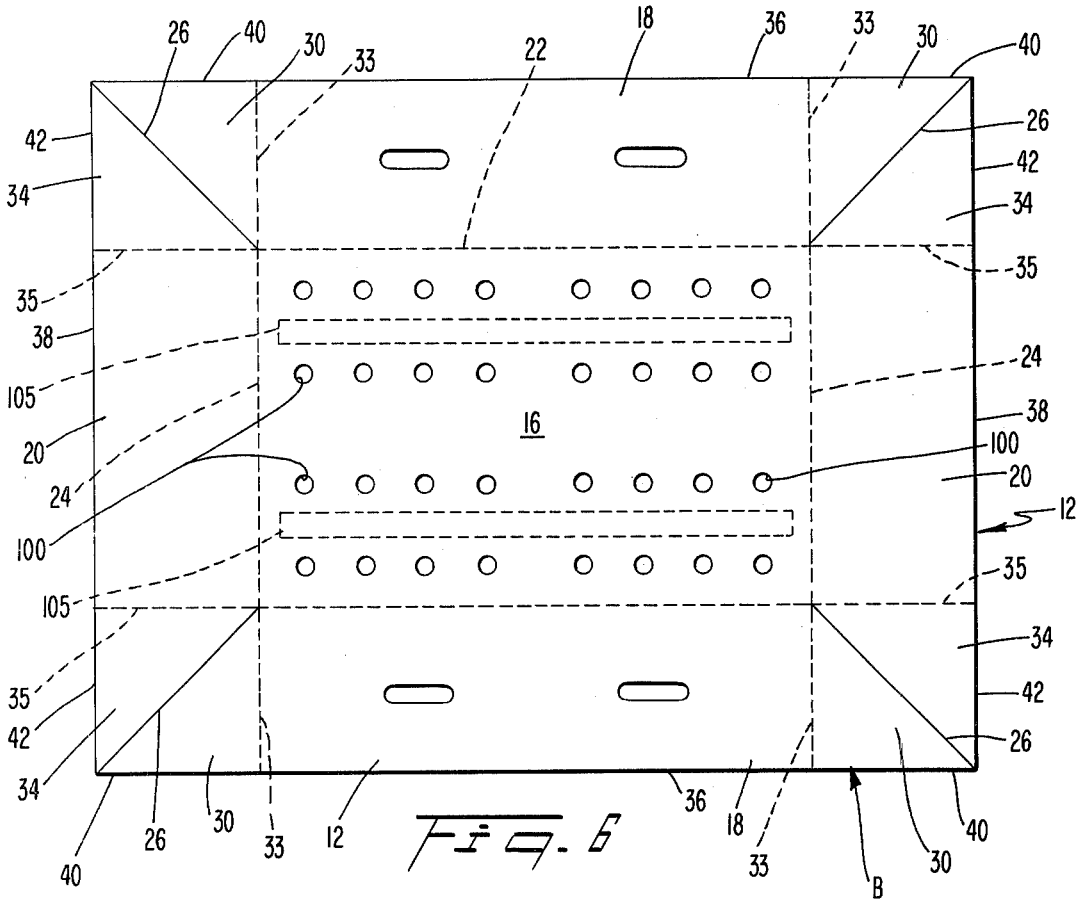
FIG. 6 is a plan view of a blank to be used in erecting a master container.

In its erected posture, the base portion 12 includes a rectangular bottom wall or floor 16, a pair of upstanding parallel side walls 18, and a pair of upstanding parallel side or end walls 20. The base portion 12 is to be erected from a blank B depicted in FIG. 6. It will be realized that the side walls 18 are integrally connected with the bottom 16 along mutually parallel horizontal fold lines 24 which are perpendicularly disposed relative to the fold lines 22 of the side walls.

Four diagonal slits 26 are located at the four corners of the rectangular base blank B. These slits 26 separate a pair of side flaps 30 that are integrally connected to opposite ends of the side wall 18, from a pair of end flaps 34 that are integrally connected at opposite ends of the end walls 20. The side flaps 30 are connected by way of fold lines 33, and the end flaps 34 are connected by way of fold lines 35.

In an erected or assembled condition of the blank B, the side walls 18 comprise a bottom edge defined by the fold line 22, a top edge 36 situated parallel to the bottom edge 22, and a pair of mutually parallel upstanding side edges defined by the fold lines 33. In like fashion, the end walls 20 each include a bottom edge defined by the fold lines 24, a top edge 38 extending parallel to the bottom edge, and a pair of mutually parallel end edges defined by the fold lines 35.

The peripheral edges of each side flap 30 are comprised of the fold line 33, an upper edge 40 extending parallel to and inwardly of the top edge 38 of an adjacent end wall 20, and a diagonal edge defined by the associated slit 26.

The peripheral edges of each end flap 34 are comprised of the fold line 35, an upper edge 42 extending parallel to and outwardly of an adjacent side wall 18, and a diagonal edge defined by the associated slit 26.

Any or all of the fold lines 22, 24, 33, 35 may be suitably scored in order to facilitate folding of the respective walls and flaps.

The retaining band 14 comprises a resilient band which can be stretched over the erected base portion so as to extend around the top of the master container as formed by the side walls 18, end walls 20, and end flaps 34. In this fashion, these walls and flaps are held in an upstanding or erected condition.

The band 14 can be formed of any suitable material, such as plastic webbing or nylon, of various widths. The inherent resiliency of such materials provides for sufficient stretching for insertion of the band, and a high degree of tautness for retaining the container shape.

The sub-containers 11 are adapted to seat within the master container 10 in side-by-side relation. These sub-containers 11 are basically similar in construction to the master container but in smaller scale. It will be appreciated that the sub-containers can be sized so that any desired number can be nested within the master channel 10.

Figure 5:
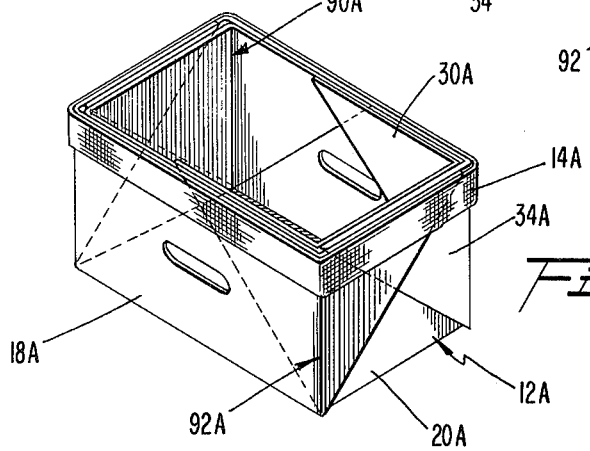
FIG. 5 is an isometric view of an empty sub-container.

Each sub-container 11 comprises a base or compartment-defining portion 12A and a retaining collar or band 14A (FIG. 5).

Figure 7:
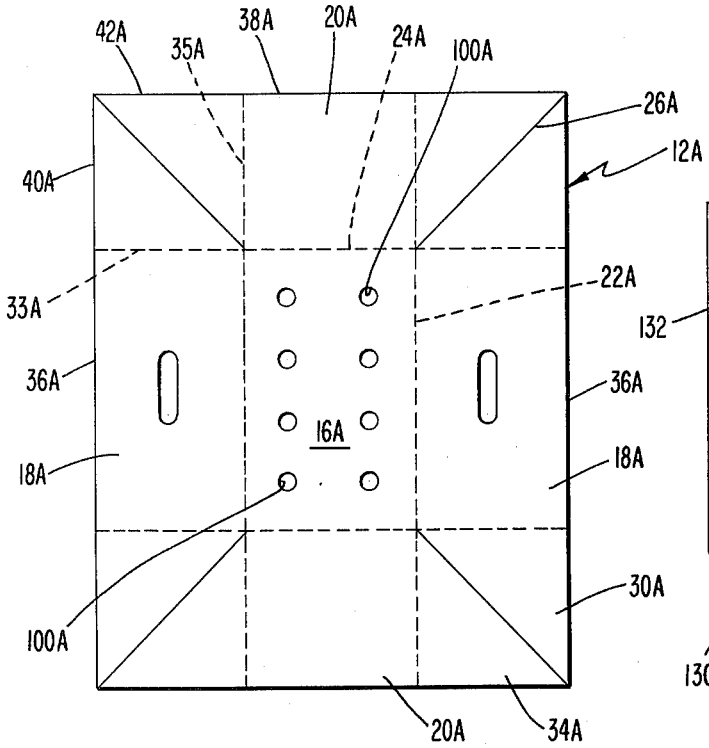
FIG. 7 is a plan view of a blank to be used in erecting a master container.

The base portion 12A is to be erected from the blank C depicted in FIG. 7.

In its erected posture, the base portion 12A includes a rectangular bottom or floor 16A, a pair of upstanding parallel side walls 18A, and a pair of upstanding parallel side or end walls 20A. The side and end walls 18A, 20A are integrally connected with the bottom 16A along mutually parallel horizontal fold lines 22A, 24A, respectively, which are relatively perpendicularly disposed.

Four diagonal slits 26A are located at the four corners of the rectangular base blank C. These slits 26A separate a pair of side flaps 30A that are integrally connected to opposite ends of the side wall 18A, from a pair of end flaps 34A that are integrally connected at opposite ends of the end walls 20A.

In an erected or assembled condition of the blank C, the side walls 18A comprise a bottom edge defined by the fold line 22A, a top edge 36A situated parallel to the bottom edge 22A, and a pair of mutually parallel upstanding side edges defined by fold lines 33A of the side flaps 30A. In like fashion, the end walls 20A each include a bottom edge defined by the fold lines 24A, a top edge 38A extending parallel to the bottom edge, and a pair of mutually parallel end edges defined by fold lines 35A of the end flaps.

The peripheral edges of each side flap 30A are comprised of the fold 33A and upper edge 40A extending parallel to and inwardly of a top edge 38A of an adjacent end wall 20A, and a diagonal edge defined by the associated slit 26A.

The peripheral edges of each end flap 34A are comprised of the fold line 35A, an upper edge 42A extending parallel to and outwardly of an adjacent side wall 18A, and a diagonal edge defined by the associated slit 26A.

Any or all of the fold lines 22A, 24A, 33A, 35A may be suitably scored in order to facilitate folding of the respective walls and flaps.

The retaining band 14A is similar to that of the master container 10. It comprises a resilient band which can be stretched and inserted around the upstanding periphery of the base 12A. In this fashion, these walls and flaps are held in an upstanding condition.

The band 14A is preferably formed of the same material as the band 14 of the master container and is capable of repeated use.

A principal advantage of the container assembly 8 lies in the high level of strength exhibited for withstanding vertical and torsional loading. As was previously noted, containers, especially those carrying fruits, are generally shipped and stored in a vertically stacked condition, thereby placing significant loading on the lower containers.

The master container 10 and sub-containers 11 are characterized by high strength corners which effectively withstand heavy vertical and torsional loading. That is, each corner of the master container 10 is established by a pair of inner and outer substantially right angle corner folds 90, 92. The inner corner folds 90 are formed by a side wall 18 and its side flaps 30, and the outer corner folds 92 are formed by an end wall 20 and its flaps 34. Each corner fold provides great resistance to vertical and torsional loading. That is, vertical forces applied at each corner are distributed along the top edges of the end and side walls and the upper edges of the side and end flaps. The forces imposed on the flaps are resisted by countermoments developed along the fold lines 28, 32 where the flaps 30, 32 are joined to the end and side walls 18, 20. Thus, where a container having no corner folds, or less than two corner folds at each corner, might have a tendency to buckle under the influence of a given vertical weight, the master container 10 of the present invention is able to easily withstand such loads.

The strength of the container assembly is further enhanced by the corner folds 90A, 92A of the sub-containers, which become nested within the corner folds 90, 92 at each corner of the master container 10. The heights of the side walls 18, 18A and of the end walls 20, 20A of the master container and sub-container are essentially the same so that all of the corner folds 90, 90A, 92, 92A are operable to support vertical loads. Collectively, then, the master container 10 and containers 11 provide an assembly having four nested corner folds at each corner thereof which are capable of withstanding substantial vertical and torsional loading. As a result, the containers are less likely to collapse and may be stacked in greater heights.

Moreover, the corner folds of the sub-containers 11 which are located at points 94 intermediate the ends of the side walls 18 of the master container provide a four corner fold at each of these points. This lends further strength and rigidity to the container assembly.

In the event that four or more sub-containers 11 are utilized, the point 96 where corners of all of the sub-containers meet is characterized by eight corner folds, thereby providing substantial internal strength to the assembly 8.

The novel container assembly 8 of the present invention makes possible a highly advantageous method of handling goods. In practice, the master containers 10 and sub-containers 11 are erected. The sub-containers 11 can be filled before or after being inserted within the master container. For example, in the case of citrus fruit being picked in the field, workers can collect fruit in the sub-containers which are then carried to a vehicle, such as a fork lift truck.

Once the master containers 10 are filled, they are transported in vertically stacked relationship. Each container assembly 8, even those stacked at or near the bottom, withstands the forces occurring during this phase due to the rigidity provided by the corner-fold arrangement at the corners and points 94, of the assembly, as discussed earlier.

The master container is broken down at a first unloading station by removing the resilient band 14 and unfolding the side and end walls 18, 20. As a result, the sub-containers 11 are exposed for handling. The sub-containers can then be carried to a second unloading station, such as an aisle within a store, where the goods are removed.

For example, in the case of citrus fruits, the master containers 10 can be taken to an unloading station in a retail food store where they are broken down. The sub-containers can then be easily carried into the display area where the fruit is deposited onto the shelves. In this manner, the aisles are not blocked by the larger, heavier master containers, and only that amount of fruit which is needed (which might be less than that of the entire master container) can be carried to the shelf in one or more sub-containers. Removal of the fruit from the sub-container can be effected by merely placing the sub-container onto the shelf, or bin, slipping off the band 14A, and allowing the side and/or end walls 18A, 20A to collapse so that the fruit rolls out. This procedure is rapid and is effective even if the entire master container 10 is brought to the aisle since it facilitates unloading of the fruit as compared with having to manually transfer each individual piece of fruit from the master container.

It will be appreciated, then, that the goods can be taken to their final display location by means of the easily-handled sub-containers. The goods can be removed from the sub-containers while the latter are in an assembled condition (as in the case of bottles, for example (FIG. 1)); or the sub-containers can be broken down by simply slipping off the easily-removable band 14A to enable the goods to be carried in stacks (as in the case of packaged goods, for example), or simply rolled from the sub-container as in the case of fruit and the like.

It is apparent, then, that transporting of the goods is made safe by the ridigity of the multiple corner fold arrangement, and unloading of the goods is accomplished more rapidly since mere removal of the retaining band 14 exposes the sub-containers. There is no longer the need to rip a glued or stapled box apart as is conventionally done. In addition, the goods can be removed from the sub-containers in more convenient fashion since the latter are easily handled and can themselves be broken down by merely removing a retaining band 14A to fully expose the goods.

The present invention also renders the over-all handling of goods more economical since the master containers, sub-containers, and retaining bands are reusable.

The master and sub-containers 10, 11 can be provided with ventilation ports 100, 100A in the base or side or end walls to aerate the goods, which is especially desirable when handling citrus fruits. The ports in the master container are aligned with corresponding ports in the sub-containers to assure that ventilation occurs.

Some ports 62 can be horizontally elongate to form gripping handles in the master container 10 and/or the sub-containers.

It will be realized that with a series of upwardly open container assemblies disposed in a stacked condition, air can be conducted relative to the compartments through the openings in the bottoms of the master and sub-containers. Vertical air circulation between the vertically stacked container assemblies is possible since the bottom vent openings of one container communicate with the upwardly open container disposed therebelow.

It should be noted that in the shipment of citrus fruits the container 10 would not require a cover, but rather would remain open at its top since the container base portion alone provides sufficient strength to support a stack of containers. If desired, however, a cover could be provided.

To further promote air circulation, the upper edges of the sidewalls can be formed with recesses or depressions at non-load-bearing regions. Thus, when containers are stacked air can circulate through the recesses, i.e., can pass through the top of the container with the recesses and the bottom of the container stacked thereon.

The underside of the floor 16 of at least some of the master containers 10 is provided with a pair of pallet risers 105 which are advantageously formed of the same material as the base, such as paperboard, for example. The risers provide for the reception of a fork elements of a fork-lift vehicle.

Assemblage of the master container and sub-containers 10, 11 can be facilitated through the use of an erecting form 110, as depicted in FIG. 10. The form 110 comprises a hollow rectangular frame defining an opening of approximately the same size as the floor 16 of the master container (or floor 16A of the sub-container 11) or perhaps slightly larger. The blank B (or blank C) is laid over the form 110 so that th floor overlies the form opening. By applying a downward force to the floor, the floor is caused to enter the opening, thereby automatically causing the side and end walls to be slightly raised. In response to this initial raising of the side and end walls, the side and end flaps are appropriately oriented such that the side flaps are positioned inwardly and abreast of the adjacent end walls, with the end flaps 34 extending outwardly and abreast of the side walls. The upper edges of the flaps are at essentially the same level as the top edges of the side and end walls. Continued insertion of the bottom wall into the form opening brings the side and end walls 18, 20 and side and end flaps 30, 34 to a substantially upright posture, enabling the band 14 to be inserted over the base. Since to form holds the base in its upright position, the operator has both hands free to stretch and insert the band. The container is thus assembled and ready for use.

The form 110 can be advantageously utilized at any location where the fruit is to be packaged, even in the growing orchards during picking of the fruit.

The method of assemblage just described is applicable to other forms of containers as well, such as those of hexagonal configuration, similar to that disclosed in the inventor's U.S. Pat. No. 3,967,772, issued July 6, 1976, the disclosure of which is hereby incorporated by reference. By configuring the form 110 hexagonally, a hexagonal blank can be accommodated. Naturally, other types and shapes of containers can be assembled by such a method.

It may be desirable to provide a tray 120 which sits on the bottom 16 of the master container 10 and which is adapted to support all of the sub-containers. The tray may include recesses 122 which conform to the size of the base of the sub-containers so that the sub-containers can rest therewithin. Once the master container 10 has been broken down, the tray may be lifted. For example, the tray may have spaced risers (not shown) which accommodate the fork of a lift truck. A plurality of trays can be stacked atop this tray so that the entire stack can be carried by the truck.

Figure 8:
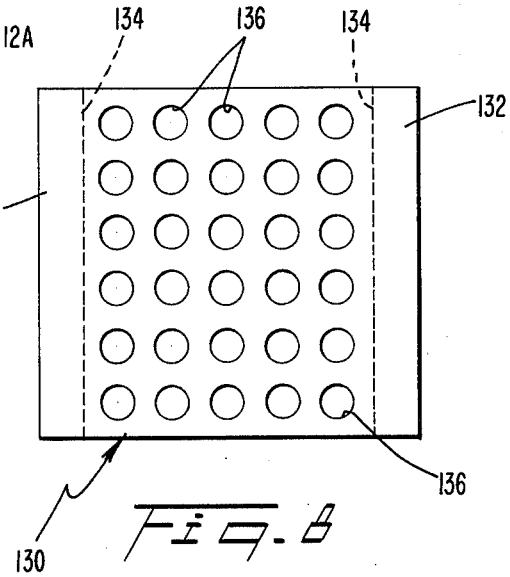
FIG. 8 is a plan view of a blank to be employed in forming a bottle spacer.

In the event that bottles B are shipped, a spacer 130 (FIGS. 2, 8, 9) may be employed to prevent the bottles from rattling or striking one another. The spacer 130 includes end lips 132 which are foldable along fold lines 134. The main part of the spacer 130 includes openings 136 for receiving the bottles. In practice, the spacer 130 is inserted over the bottles in the sub-container with the end lips 132 bent upwardly. The bottles enter the openings 136. Since the bottles have a tapered shape, the spacer will descend until the openings tightly engage the bottles. The end lips will engage the end walls 20A in an upright fashion. When the master containers are stacked, the inserts 130 are prevented from displacement by contact of the end lips 132 with the base of a master container located thereabove.

It is contemplated that in one instance, a paperboard master container utilized to ship citrus fruits could be formed in accordance with the principles of the present invention with dimensions of about 32 inches × 22 inches × 11 inches deep. The sub-containers can be about 16 inches × 11 inches × 11 inches deep which is about the size of standard fruit containers.

While the preferred container 10 has side walls that are longer than the end walls, it should be understood that the principles of the present invention are applicable to all rectangular container shapes, including square containers where the side and end walls of equi-length.

While the container 10 has been described as being erected so as to position the end flaps exteriorly of the side walls and the side flaps interiorly of the end walls, it is also within the scope of the invention that the side flaps be folded exteriorly of the end walls, with the end flaps being folded exteriorly of the side walls if desired.

By virtue of the present invention, then, a highly rigid and sturdy container assembly is provided which is capable of withstanding greater vertical and torsional loads. As a result, transporting of goods in greater bulk is possible along with increased economy and safety.

The arrangement of sub-containers within a master container, wherein each are broken down by mere removal of an elastic band greatly facilitates unloading of the goods and insertion of the goods onto shelves. This can be accomplished quickly and with less cluttering of aisles.

Since the master containers, sub-containers, and elastic bands can be broken down and conveniently stored for reuse, the overall expenses involved in transporting goods can be significantly reduced.

The flexible band is particularly useful in yieldably restraining the container sides while relatively easy to remove. Problems which can be encountered in removing a rigid band after a container is expanded by the goods are greatly alleviated by the stretchable band.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A reusable rectangular container assembly comprising:

a master container comprising:

a base portion formed of foldable, non-metallic material and including:

a rectangular bottom wall, a pair of side walls connected to said bottom wall so as to be foldable between a collapsed position and un upright position at opposite sides of said bottom wall, a pair of end walls foldably connected to said bottom wall so as to be foldable between a collapsed position an un upright position at opposite ends of said bottom wall, said end and side walls defining a compartment therebetween when disposed in upright positions;

a pair of side flaps connected to opposite ends of each side wall so as to be foldable between a collapsed position and a position lying abreast of and parallel to an adjacent upright end wall, said side flaps and side walls forming a first substantially right angle corner fold at each corner of the master container, a pair of end flaps connected to opposite ends of each end wall so as to be foldable between a collapsed position and a position lying abreast of and parallel to an adjacent upright side wall, said end flaps and end walls forming a second substantially right angle corner fold at each corner of the master container, said first and second corner folds at each corner being disposed in upstanding, nested relationship in an erected condition of said container; and an elastically resilient band removably positioned around upper portions of said end and side walls of said base portion to support said end and side walls in upstanding position; and a plurality of sub-containers insertable within said master container, each sub-container comprising:

a base portion formed of foldable, nonmetallic material and including:

a rectangular bottom wall, a pair of side walls connected to said last-named bottom wall so as to be foldable between a collapsed position and an upright position at opposite sides of said last-named bottom wall, a pair of end walls foldably connected to said last-named bottom wall so as to be foldable between a collapsed position and an upright position at opposite ends of said last-named bottom wall, said last-named end and side walls defining a compartment therebetween when disposed in upright positions;

a pair of side flaps connected to opposite ends of each last-named side wall so as to be foldable between a collapsed position and a position lying abreast of and parallel to an adjacent upright end wall, said last-named side flaps and side walls forming a first substantially right angle corner fold at each corner of the sub-container, a pair of end flaps connected to opposite ends of each last-named end wall so as to be foldable between a collapsed position and a position lying abreast of and parallel to an adjacent upright side wall, said last-named end flaps and end walls forming a second substantially right angle corner fold at each corner of the sub-container, said first and second corner folds at each corner being disposed in upstanding, nested relationship in an erected condition of said container; and an elastically resilient band removably positioned around upper portions of said end and side walls of said last-named base portion to support such end and side walls in upstanding positions;

said sub-containers being insertable in side-by-side relation within said master container so that the first and second corner folds of a sub-container are nested within the first and second corner folds at each corner of said master container to provide four upright corner folds at each corner of said master container; and said corner folds of said sub-containers being of substantially the same height as the corner folds of said master container so that said corner folds of said sub-containers and master container together form a support column for vertical support when a plurality of master containers are stacked;

said resilient band of said master container being removable to expose said sub-containers for handling and to enable said master container to be stored for reuse; said resilient band of said sub-containers being removable to enable said sub-containers to be stored for reuse.

2. A container assembly according to claim 1 whereby in both said master and sub-containers said side walls are longer than said end walls; said side flaps each extending along at least half the length of the associated end wall, and said end flaps extending along at least one-third the length of the associated side wall.

3. A container assembly according to claim 1 whereby in both said master and sub-containers said side flaps are situated inwardly of said end walls, and said end flaps are situated outwardly of said side walls.

4. A container assembly according to claim 1 wherein spaced paperboard pallet risers are mounted to the underside of the bottom wall of said master container, and ventilation openings are provided in said last-named bottom wall between said pallet risers.

5. A container assembly according to claim 1 wherein the bottom wall of each sub-container includes ventilation openings aligned with those in said master container.

6. A container assembly according to claim 1 including a tray disposed in said master container upon which said sub-containers are seated.

7. A container assembly according to claim 6 wherein said tray includes recesses receiving said sub-containers.

8. A container assembly according to claim 1 including a spacer having openings for receiving the tapered necks of bottles carried in said sub-container; said spacer including upright end lips which terminate at an upper edge of said sub-container to engage a bottom wall of a master container stacked thereabove to retain said spacer.

* * * * *